United States Patent [19]

Beamer

[11] 4,235,379

[45] Nov. 25, 1980

[54] INTERCHANGEABLE NOZZLE APPARATUS FOR FULL OR PART CIRCLE IRRIGATION SPRINKLERS

[75] Inventor: John D. Beamer, West Covina, Calif.

[73] Assignee: Rain Bird Sprinkler Mfg. Corp., Glendora, Calif.

[21] Appl. No.: 899,062

[22] Filed: Apr. 24, 1978

Related U.S. Application Data

[63] Continuation-in-part of Ser. No. 873,225, Jan. 30, 1978, abandoned.

[51] Int. Cl.[3] ..... B05B 3/08

[52] U.S. Cl. ..... 239/230; 239/390; 239/396; 239/596; 239/600; 285/177

[58] Field of Search ..... 239/230, 390, 391, 396, 239/436, 589, 591, 596, 600-602, DIG. 1, 231-233; 285/177, 328, 386; 403/309, 344, 359

[56] References Cited

U.S. PATENT DOCUMENTS

| | | | |
|---|---|---|---|
| 251,448 | 12/1881 | Long et al. | 239/596 |
| 259,131 | 6/1882 | Gould | 239/391 |
| 1,739,226 | 12/1929 | Goss | 239/591 |
| 2,679,911 | 6/1954 | Bhend | 285/177 X |
| 3,623,666 | 11/1971 | Meyer | 239/230 |
| 4,042,174 | 8/1977 | Vaughn | 239/391 X |

FOREIGN PATENT DOCUMENTS

| | | | |
|---|---|---|---|
| 2315320 | 1/1977 | France | 285/177 |
| 517045 | 2/1955 | Italy | 239/230 |
| 20175 | of 1911 | United Kingdom | 239/390 |

*Primary Examiner*—Andres Kashnikow

*Attorney, Agent, or Firm*—Fulwider, Patton, Rieber, Lee & Utecht

[57] ABSTRACT

For use with an irrigation sprinkler, an interchangeable nozzle apparatus is provided which includes a tubular housing mounted at the discharge end of the sprinkler, and arranged to receive any of a plurality of insert members which may be selected for controlling the flow rate of water ejected from the nozzle, controlling the distribution of water over the range of throw of the sprinkler, or enhancing the range of throw of the sprinkler when water is supplied to the sprinkler at relatively low pressures. In part-circle applications on a reaction drive type sprinkler, the inserts are arranged to limit movement of the reverse drive arm into the stream of water ejected from the nozzle by an amount dependent upon the nozzle size, thereby resulting in substantially the same reversing force regardless of nozzle size.

24 Claims, 10 Drawing Figures

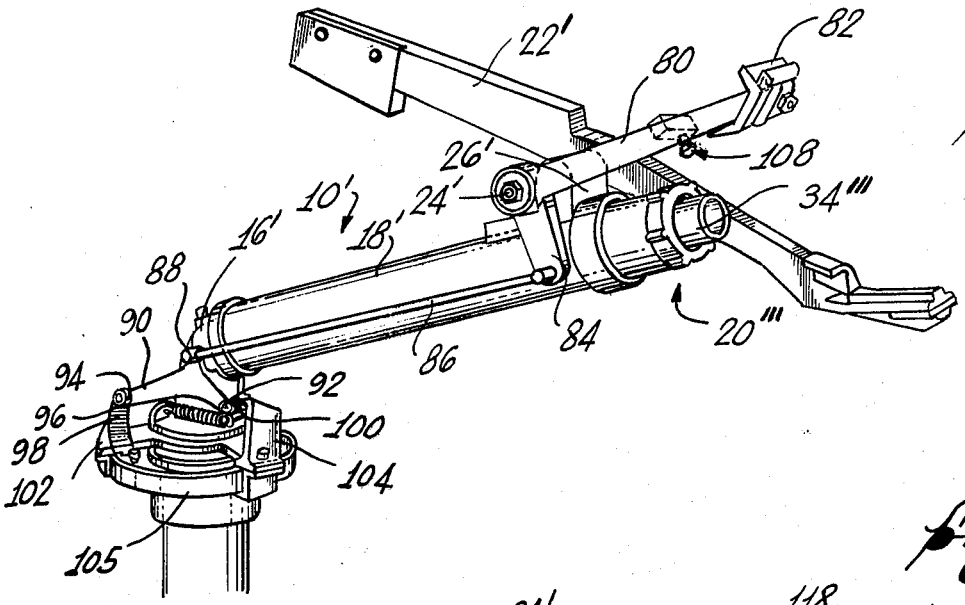
Fig. 8
Fig. 9
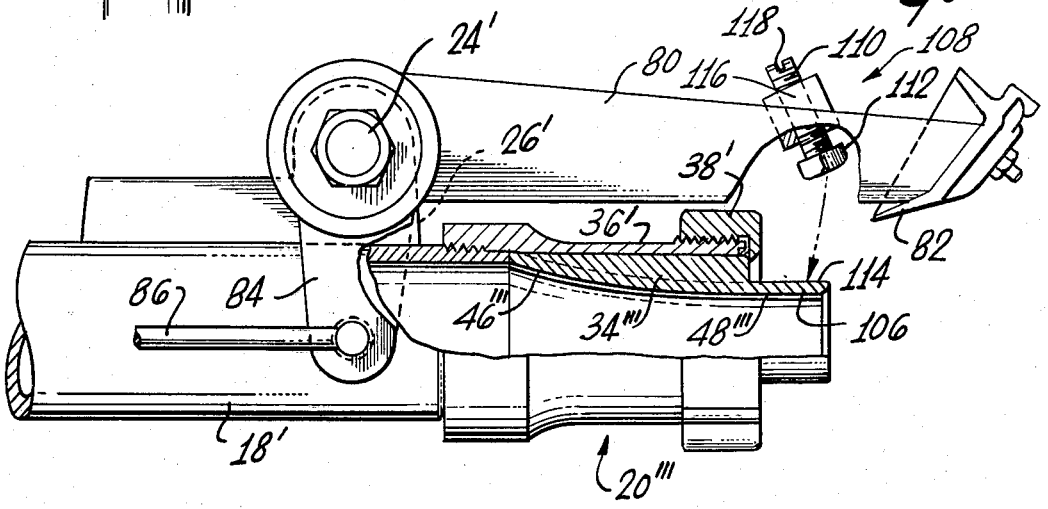
Fig. 10
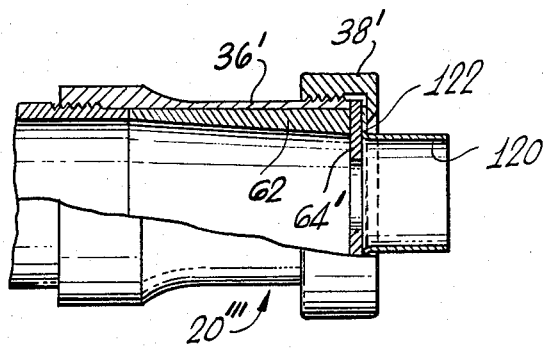

INTERCHANGEABLE NOZZLE APPARATUS FOR FULL OR PART CIRCLE IRRIGATION SPRINKLERS

BACKGROUND OF THE INVENTION

This is a continuation-in-part of prior co-pending application Ser. No. 873,225, filed on Jan. 30, 1978, now abandoned.

This invention relates generally to nozzles for irrigation sprinklers, and, more particularly, to an interchangeable nozzle for selectively varying the size and shape of the outlet orifice of such sprinklers.

As is well known in the art, it is highly desirable for an irrigation sprinkler, particularly of the so-called large gun type, to be provided with a means for varying the size and shape of the outlet orifice of the sprinkler so that the user of the sprinkler may selectively vary the characteristics of the flow of water emitted by the sprinkler according to, for example, varying seasonal requirements. It may be desired, for example, to control the flow rate of the water emitted from the sprinkler, to control the distribution of water over the range of throw of the sprinkler, or to enhance the range of throw of the sprinkler when water is supplied to the sprinkler at relatively low pressures.

One way in which this has been accomplished is by providing the large gun type sprinklers with a set of interchangeable orifice rings which may be secured to the discharge end of a generally frusto-conical housing mounted on the discharge tube of the sprinkler. These rings restrict the discharge orifice and reduce the flow rate through the sprinkler.

Another method for varying the shape of the outlet of such a sprinkler is to mount a housing on the discharge tube of the sprinkler which has the desired shape formed integrally at its outlet. The desired shape may be, for example, a converging frusto-conical outlet for enhancing the distribution of water over a relatively short range of throw, or a substantially straight bore outlet for enhancing the range of throw of a sprinkler when operated at a relatively low supply pressure.

Although these methods function satisfactorily, if it is desired to vary the size as well as the shape of the outlet, a separate unit, including housing and outlet, must be provided for each combination of size and shape desired. Moreover, the housings of all of the above described nozzle arrangements are subjected to the highly abrasive flow of water through the sprinkler which adversely affects their wear life. The cost of providing a separate nozzle, including housing and outlet, for every combination of size and shape desired, when added to the cost of periodic replacement of these nozzles, significantly increases the cost of operating an irrigation system.

In part-circle applications, a reaction drive type sprinkler is rotatably driven by a reaction arm in a first direction about a vertical axis in a manner well known in the art. When the sprinkler has been rotated through a pre-selected arc, a camming mechanism operates to move a reverse drive arm, thereby placing a reverse deflector spoon in the stream of water ejected from the sprinkler. The reaction force created by the stream of water impinging on the deflector spoon rotates the sprinkler in a reverse direction back through the same pre-selected arc, and at the other end of the arc, the camming mechanism operates to move the deflector spoon out of the stream of water and normal operation of the sprinkler in the first direction is resumed. One sprinkler of the foregoing general type is the Model 103 Rain Gun manufactured by Rain Bird Sprinkler Mfg. Corp., of Glendora, California.

If the reverse deflector spoon moves too far into the stream, the resulting higher reaction force on the spoon can rotate the sprinkler very rapidly in the reverse direction, thereby causing increased wear and possible damage to the sprinkler. To avoid this possibility, reverse drive arms have been provided with a means for adjusting the extent to which the reverse deflector spoon enters the stream. Although the mechanisms provided for this purpose function satisfactorily, whenever the nozzle size is changed, as described above, it is necessary to readjust the reverse drive arm to achieve proper reverse rotational speed of the sprinkler.

Accordingly, there has existed a need for a convenient and effective device for varying the size and shape of the outlet orifice of a sprinkler, particularly of the large gun type, which is relatively inexpensive to manufacture and does not subject its housing to the abrasive flow of water though the sprinkler. Further, there exists a need for a sprinkler of the foregoing type which includes some means associated with its reversing mechanism for automatically compensating for nozzles of different sizes. As will become apparent from the following, the present invention satisfies these needs.

SUMMARY OF THE INVENTION

The present invention resides in a new and improved nozzle for use in irrigation sprinklers, primarily of the large gun type, and by which the sizes and shape of the outlet of the sprinklers may be selectively varied by interchangeably retaining a plurality of nozzle insert members in a single housing attached to the discharge end of the sprinkler. When used in combination with part-circle sprinklers, each insert member is arranged to cooperate with the reverse drive arm of the sprinkler so that the operative position of the reverse deflector spoon is automatically adjusted to provide the desired reverse rotational speed of the sprinkler. Moreover, the nozzle of the present invention is relatively inexpensive to manufacture, is trouble free and reliable in use, and attains its advantageous result without subjecting the housing to the abrasive flow of water through the sprinkler.

More specifically, the nozzle of the present invention includes a housing which is secured to the outlet end of the sprinkler and extends outwardly from the sprinkler. All of the interchangeable nozzle inserts are of the same exterior size so that they fit uniformly in the same housing and are held firmly in the housing by the same retaining collar. The inlet of each of the inserts has a diameter which matches the diameter of the discharge end of the sprinkler, and the outlet of each of the inserts may be of any smaller diameter.

The inner wall of one set of inserts which defines a passage from the inlet to the outlet can decrease in diameter at a constant rate through the insert thereby forming a converging frustoconical surface for enhancing the rapid breakup of a stream of water ejected from that insert. The inner wall of another set of inserts can decrease in diameter at a constant rate to a desired diameter and then provide a region of constant diameter, or a straight bore portion adjacent the outlet. This type of insert can be selected for achieving an enhanced range of throw over the range achieved by the aforementioned frustoconical insert.

The inner wall of yet another set of inserts can decrease in diameter at a gradually decreasing rate from the inlet to the outlet and end in an asymptotic portion which approaches a substantially straight bore outlet. A stream of water flowing through such an insert is gradually reduced in diameter and passes smoothly into the asymptotic portion of the insert immediately before being emitted from the nozzle, thereby causing the stream to be highly collimated and achieving an enhanced range of throw when water is supplied to the sprinkler at relatively low pressures.

For use in connection with part-circle sprinklers, the insert member can include an axially extending portion adjacent its outlet end and projecting outwardly from the nozzle housing. For limiting the movement of the reverse deflector spoon into the steam of water ejected from the sprinkler, an adjustable stop is provided on the reverse drive arm in a position for abutting the extending portion of the insert member when the reverse deflector spoon is moved into the stream. In this way, the operative position of the reverse deflector spoon is automatically adjusted to provide substantially the same reverse rotational speed of the sprinkler regardless of the size of the nozzle being used.

Alternatively, the housing may be adapted for use with conventional ring orifice devices by placing a liner insert in the housing to protect the housing from wear, and securing a ring orifice to the outlet end of the housing using the same retaining collar used to secure the other sets of interchangeable inserts within the housing. The liner insert has an inlet diameter which matches the diameter of the discharge end of the sprinkler, and the inside diameter of the liner insert decreases along its length for directing the stream of water flowing through the nozzle toward the discharge aperture in the ring orifice. When this arrangement is used in connection with a part-circle sprinkler, an axially extending portion can be secured to the ring orifice for projecting outwardly from the nozzle housing and cooperating with the stop on the reverse drive arm in the same manner as described above.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 8 is a perspective view of a nozzle assembly of an alternative embodiment of the present invention, and illustrated assembled on a conventional part-circle sprinkler of the large gun reaction drive type;

FIG. 9 is an enlarged fragmentary view, partly in section, showing relevant detail of the nozzle assembly and reverse drive arm construction of the sprinkler of FIG. 8; and FIG. 10 is an enlarged, fragmentary, cross-sectional view, similar to the view of FIG. 9, and illustrating the ring orifice assembly of the present invention adapted for use in connection with a part-circle sprinkler.

DETAILED DESCRIPTION

Figure 1:
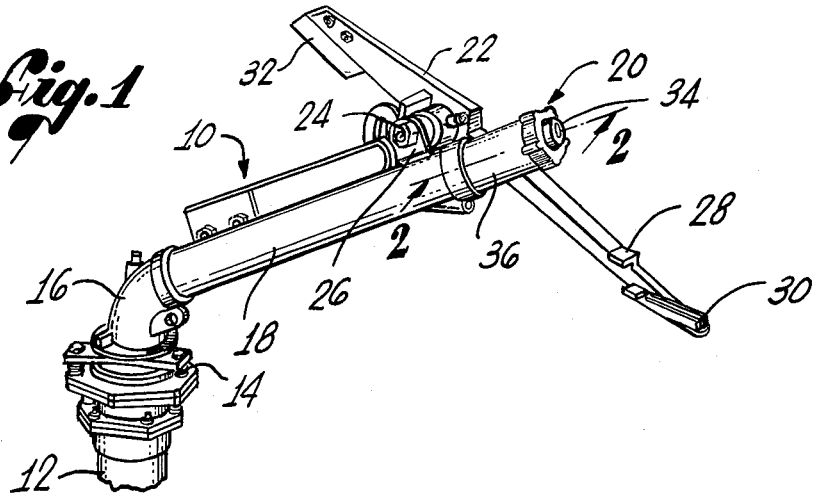
FIG. 1 is a perspective view of a nozzle assembly embodying the present invention, and illustrated assembled on a conventional sprinkler of the large gun reaction drive type.

As shown in the exemplary drawings, the present invention is embodied in a nozzle assembly for use with an irrigation sprinkler of the impact or reaction drive type, and herein is shown in the drawings as a large gun reaction drive type sprinkler, indicated generally by reference numeral 10 in FIG. 1. In this instance, the sprinkler 10 is mounted for rotation about a vertical axis on a water supply pipe 12, and includes a rotational bearing portion 14, an elbow 16, and a range tube 18 through which water travels to a nozzle, indicated generally by reference numeral 20.

When in use, water is admitted under pressure into the sprinkler 10 through the supply pipe 12, and travels through the elbow 16 and the range tube 18 to the nozzle 20. The nozzle 20 ejects the water upwardly and outwardly away from the sprinkler 10, the distance of throw being a function of nozzle size, the supply pressure of the water admitted to the sprinkler, and the degree of collimation of the stream of water ejected from the nozzle.

To drive the sprinkler 10, a reaction arm 22 herein is mounted for rotation about a horizontal axis on a pin 24 extending from a boss 26 on the range tube 18. The arm 22 includes, at one end, an inner water deflecting portion 28 and an outer water deflecting portion 30, and a counter weight 32 disposed at its other end.

During the operation of the sprinkler 10, the water deflecting portions 28 and 30 intermittently enter the stream of water emitted from the nozzle 20 and deflect a portion of the stream of water laterally. The reaction to the force required to deflect that water is imposed on the boss 26 through the arm 22 thereby imparting to the sprinkler 10 an increment of rotational movement. The operation of the reaction arm 22 to drive the sprinkler 10 is well known in the art, and it is not believed necessary to describe that operation in detail here.

When arranged for part-circle operation, as can best be seen in FIG. 8, the sprinkler 10' includes a reverse drive arm 80. The part-circle sprinkler illustrated in exemplary FIGS. 8 through 10 is substantially like that previously discussed in connection with FIG. 1, and parts of the sprinkler of FIGS. 8 through 10 which find substantial correspondence in structure and function to those previously discussed in connection with FIG. 1, have been designated with corresponding primed reference numerals.

In operation of the part-circle sprinkler 10', the drive arm 22' operates to drive the sprinkler 10' through a preselected arc in the same manner as described above in connection with the full-circle sprinkler 10 of FIG. 1. In order to confine the sprinkler 10' within the preselected arc, the reverse drive arm 80 is arranged to return the sprinkler 10' back through the preselected arc, whereupon the drive arm 22' resumes operation for rotating the sprinkler in the forward direction.

Toward this end, the reverse drive arm 80 is also mounted for rotation about a horizontal axis on a pin 24' secured to a boss 26' on the range tube 18'. The reverse drive arm 80 extends above and generally parallel to the nozzle 20''', and has a reverse deflector spoon 82 at its outward end.

When the reverse deflector spoon 82 is lowered into the stream of water ejected from the nozzle 20''', the reaction force created by the water impinging on the spoon 82 acts on the sprinkler 10' through the reverse drive arm 80 and boss 26' to rotate the sprinkler 10' in a reverse direction until the spoon 82 is removed from the stream.

For rotating the reverse drive arm 80 about the pin 24', thereby moving the reverse deflector spoon 82 into and out of the stream of water ejected from the nozzle 20''', a downwardly depending crank 84 is mounted for rotation with the reverse drive arm 80. Pivotally attached to the lower end of the crank 84 is a connecting rod 86 which extends along the range tube 18' and is pivotally attached at its other end to the upper corner 88 of a generally triangular plate 90 which is pivotally secured at its lower forward corner 92 to the elbow 16'. The lower rear corner 94 of the triangular plate 90 is arranged with a roller-type cam follower 96 which is movable upwardly or downwardly by camming surfaces 98 and 100, respectively. The surfaces 98 and 100 are formed on a pair of cam brackets 102 and 104 that are releasably secured to a flange 105 so that the brackets 102 and 104 can be located at any desired circumferential position on the flange 105.

In operation of the mechanism for moving the spoon 82 into and out of the stream ejected from the nozzle 20''', as the sprinkler 10' is rotated by the drive arm 22' toward the end of the preselected arc, the camming surface 100 moves the cam follower 96 downwardly, rotating the triangular plate 90 in a counter-clockwise direction. The connecting rod 86 is thereby drawn inwardly, away from the nozzle 20''', rotating the crank 84 in a clockwise direction and moving the spoon 82 into the stream. With the spoon 82 in the stream, the sprinkler 10' rotates in a reverse direction back through the preselected arc until the cam follower 96 is moved upwardly by the camming surface 98. Upward movement of the follower 96 rotates the plate 90 in a clockwise direction, moving the connecting rod 86 outwardly toward the nozzle 20''', rotating the crank 84 in a counter-clockwise direction, and removing the spoon 82 from the stream, thereby permitting the sprinkler 10' to resume normal forward rotation under the influence of the drive arm 22'.

In accordance with the present invention, the nozzle 20 of the sprinkler 10 includes means for selectively varying the size and shape of the outlet from the sprinkler 10 by interchangeably retaining a plurality of nozzle insert members 34 in a single housing 36 of the nozzle 20 which is attached to the discharge end of a range tube 18. Moreover, when used in connection with part-circle sprinklers, each insert member is arranged to cooperate with the reverse drive arm 80 of the sprinkler so that the operative position of the reverse deflector spoon 82 is automatically adjusted to provide the desired reverse rotational speed of the sprinkler regardless of the size of insert member being used.

Further, the nozzle 20 of this invention is relatively inexpensive to manufacture, is trouble free and reliable in use, and the housing 36 of the nozzle 20 is not subject to abrasion by the water flowing through the sprinkler 10.

In order to conveniently vary the size and shape of the outlet from the sprinkler, the nozzle 20 is comprised of a single housing 36 which is arranged to receive interchangeably any one of a set of insert members 34. As will be described in greater detail hereinafter, the insert members 34 can be comprised of any desired shape and can provide the sprinkler 10 with an outlet of any desired size smaller than the discharge end of the range tube 18. To enhance the wear life of the nozzle 20, the insert members can be conveniently and economically molded of an abrasion resistant polyurethane material.

Toward the foregoing ends, the nozzle 20 is comprised of a generally cylindrical housing 36 which is threadably received over the discharge end of the range tube 18 and extends outwardly therefrom. The insert member 34 is held within the housing 36 by a collar 38 which is threadably received over the outward end of the housing 36 and includes inwardly extending portions 40 which bear against a shoulder 42 on the insert member 34, thereby holding the insert member 34 within the housing 36, and forming an abutting water seal between the discharge end of range tube 18 and the insert member 34.

The range tube 18 has an internal passage 44 through which water flows from the sprinkler 10 to the nozzle 20, and the insert member 34 has an inlet 46 and an outlet 48 for receiving and ejecting the stream of water as it flows through the nozzle 20. In order to smoothly receive the stream of water flowing through the passage 44, the insert member 34 is held within the housing 36 so that the inlet 46 abuts the discharge end of range tube 18, and the inside diameter of the inlet 46 is substantially equal to the inside diameter of the passage 44 at the discharge end of range tube 18.

Figure 2:
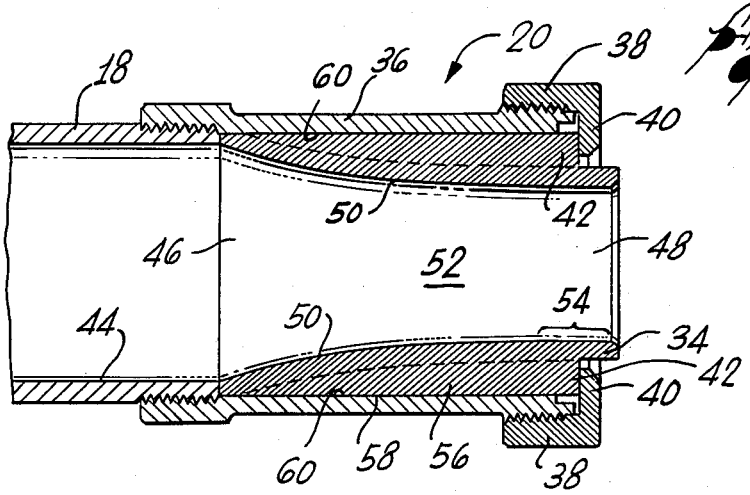
FIG. 2 is an enlarged, fragmentary, cross-sectional view of the nozzle assembly of the present invention taken substantially along line 2—2 of FIG. 1, and illustrated with a power nozzle type insert.

The insert member 34 includes an inner wall 50 which defines a passage 52 extending through the insert member 34 from the inlet 46 to the outlet 48. As seen in FIG. 2, the inner wall 50 converges toward the center of the insert member 34, and the rate of convergence of the inner wall 50 gradually decreases along the length of the insert member 34 from the inlet 46 to the outlet 48 thereby forming an asymptotic portion 54 of the passage 52 adjacent the outlet 48. The asymptotic portion 54 is nearly parallel to the axis of the insert member 34 and therefore defines a substantially straight bore outlet.

Figure 3:
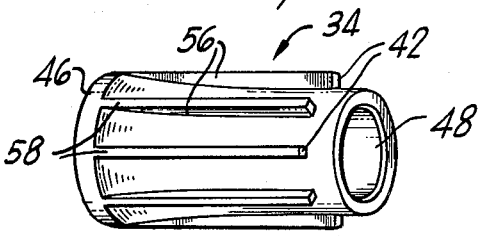
FIG. 3 is a perspective view of the insert shown in FIG. 2.
Figure 4:
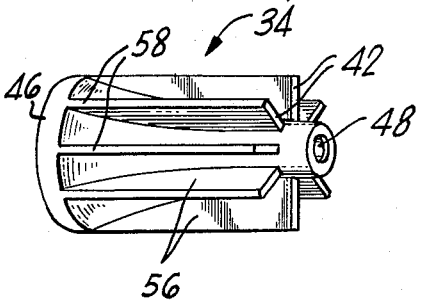
FIG. 4 is a perspective view of an insert similar to that shown in FIG. 3, but having a smaller outlet diameter.

An insert member 34 having an inner wall 50 defining any desired configuration of the passage 52 may be interchangeably disposed within the housing 36 by removing the retaining collar 38, sliding the insert member 34 out of the outward end of the housing 36, and reassembling the nozzle 20 using an insert member 34 having the desired configuration. Toward this end, as can best be seen in FIGS. 3 and 4, the insert member 34 is provided with longitudinally extending ribs 56 which extend from a point adjacent the inlet 46 toward the outlet 48 and end forming the shoulder 42. To hold the insert member 34 firmly in place when it is disposed in the housing 36, each of the ribs 56 has an outer surface 58 which is arranged to bear against the inner surface 60 of the housing 36. All of the inserts 34 are provided with ribs 56 having surfaces 58 which cooperate with the inner surface 60 of the housing 36 so that each insert 34 fits uniformly within the same housing 36. However, the various interchangeable inserts 34 can have outlets 48 of different diameters for varying the flow rate of water emitted from the sprinkler 10.

Figure 5:
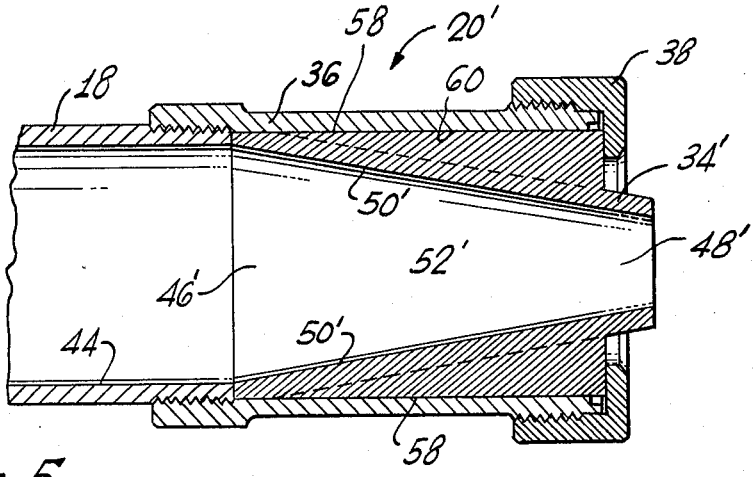
FIG. 5 is an enlarged, fragmentary, cross-sectional view of the nozzle assembly of the present invention, taken substantially along line 2—2 of FIG. 1, and illustrating a frustoconical type insert.
Figure 6:
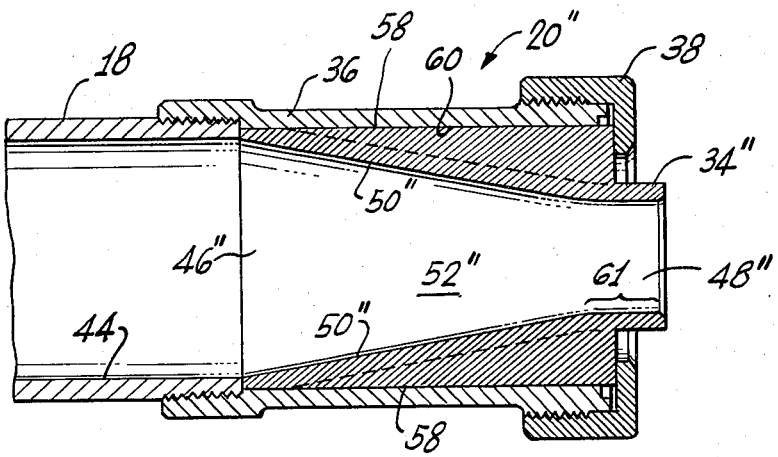
FIG. 6 is an enlarged, fragmentary, cross-sectional view of the nozzle assembly of the present invention, taken substantially along line 2—2 of FIG. 1, and illustrating a straight bore type insert.

As can best be seen in FIGS. 5 and 6, an insert member 34' may be provided having an inner wall 50' which defines a passage 52' of any desired shape. In these example, the nozzle 20' is substantially like that previously discussed in connection with the nozzle of FIGS. 1 through 4, and parts of the nozzles of FIGS. 5 and 6 which find substantial correspondence in structure and function to those previously discussed in connection with FIGS. 1 through 4, have been designated with corresponding primed reference numerals. It should be noted that the range tube 18, housing 36 and retaining collar 38 have not been designated with primed reference numerals because these parts are identical to those illustrated in exemplary FIGS. 1 through 4.

As can best be seen in FIG. 5, the insert member 34' has an inlet 46' having an inside diameter substantially equal to the inside diameter of the passage 44 at the discharge end of the range tube 18, and the wall 50' converges toward the center of the insert member 34' at a constant rate along the length of the insert member 34' from the inlet 46' to the outlet 48' thereby forming a passage 52' having a frustoconical shape. An insert member 34' may be provided having an outlet 48' of any desired diameter thereby allowing the user of the nozzle 20' to control the flow rate of water emitted from the sprinkler 10 while attaining the water distribution characteristics of a frustoconical nozzle.

As can be seen in FIG. 6, the insert member 34'' has an inlet 46'' having an inside diameter substantially equal to the inside diameter of the passage 44 at the discharge end of the range tube 18, and the wall 50'' converges toward the center of the insert member 34'' at a constant rate until the wall 50'' defines a passage 52'' having the desired diameter. Thereafter, the wall 50'' maintains a constant diameter thereby providing a straight bore portion 61 adjacent the outlet 48''.

Figure 7:
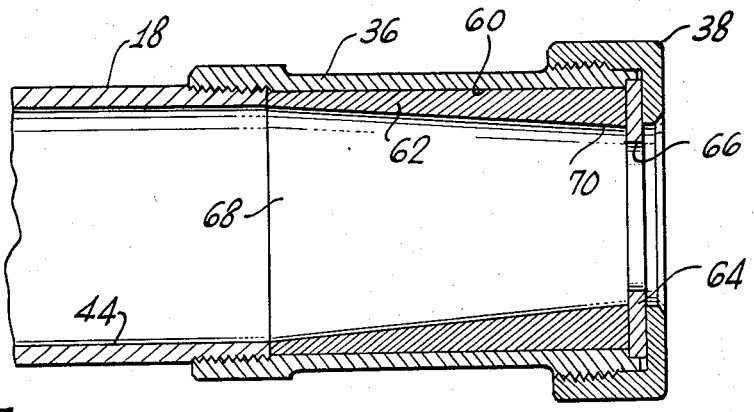
FIG. 7 is an enlarged, fragmentary, cross-sectional view of the nozzle assembly of the present invention, taken substantially along line 2—2 of FIG. 1, and illustrating a liner insert for use with a conventional ring orifice.

The nozzle 20 can further be adapted for use with conventional ring orifice devices. As can best be seen in FIG. 7, an insert member 62, which can also be molded of an abrasion resistant polyurethane material, is disposed within the housing 36 and bears against the inner wall 60 of the housing 36, and a conventional orifice ring 64, having a water discharge aperture 66, is held against the end of the insert member 62 by the collar 38. The insert 62 has an inlet 68 having an inside diameter substantially equal to the inside diameter of the passage 44 at the discharge end of range tube 18, and an outlet 70 having an inside diameter greater than the diameter of the discharge aperture 66 of the orifice ring 64. The orifice ring 64 may be interchangeably replaced by another orifice ring 64 having a discharge aperture 66 of a different diameter thereby allowing the user to selectively vary the flow rate of water emitted by the sprinkler 10.

In accordance with an alternative embodiment of the invention arranged for use with a part-circle sprinkler 10', such as that illustrated in exemplary FIG. 8, the nozzle 20''' is provided with an insert member 34''' having an axially extending portion 106 adjacent its outlet 48''' and projecting outwardly from the nozzle housing 36'. The insert member 34''' is retained within the housing 36' in the same manner discussed in connection with the sprinkler of FIGS. 1 through 7. That is, the insert member 34''' is held within the housing 36', with its inlet 46''' abutting the discharge end of the range tube 18', by the collar 38'.

For limiting the movement of the reverse deflector spoon 82 into the stream of water ejected from the sprinkler 10', and adjustable stop 108 is provided on the reverse drive arm 80 in a position for abutting the extending portion 106 of the insert member 34''' when the reverse deflector spoon 82 is moved into the stream. As can best be seen in FIG. 9, the adjustable stop 108 includes an externally threaded shaft 110 having a generally flat head 112 at its lower end for bearing against an exterior surface 114 of the projecting portion 106. The shaft 110 is received in an internally threaded bore in a boss 116 formed on the reverse drive arm 80 and the shaft includes an open slot 118 at its upper end for receiving the blade of a screwdriver (not shown) which can be used to adjustably locate the stop 108 in any desired position with respect to the boss 116.

By this arrangement, the extent to which the reverse deflector spoon 82 enters the stream is determined by the position of the stop 108, and therefore, the spoon 82 will move the same distance into the stream regardless of the size of the outlet 48''' of the insert 34''' being used. Further, it will be appreciated that any size or configuration of insert member 34''', such as those described above in connection with FIGS. 2 through 6, can be provided with an extending portion 106 in order to achieve the automatic regulation of the reverse deflector spoon 82 as described above.

When the nozzle 20''' is adapted for use with conventional ring orifice devices, it can further be adapted to automatically regulate the operative position of the reverse deflector spoon 82, as can best be seen in exemplary FIG. 10. In this instance, the nozzle 20''' is assembled in the same manner as described above in connection with exemplary FIG. 7, having an insert member 62 and orifice ring 64' retained within the housing 36' by the collar 38'. However, the orifice ring 64' is provided with an axially extending tubular extension 120 arranged to project outwardly from the nozzle 20'''. For this purpose, the tubular extension 120, which is preferably formed of stainless steel, includes a radially projecting flange 122 which is secured to the orifice ring 64' by any suitable means, such as by spot welding. In this way, the tubular extension 120 can be arranged for cooperating with the adjustable stop 108 thereby automatically controlling the reverse rotational speed of the sprinkler 10' for any size of orifice ring 64' selected.

It should be noted that each of the insert members 34, 34', 34'', 34''' and 62 effectively isolates the housing 36 from the flow of water through the nozzle 20. In this way, the wear life of the housing 36 is significantly increased, and the abrasive effect of the water flowing through the nozzle 20 acts only upon the insert members 34, 34', 34'', 34''' and 62 which are preferably formed of a moldable, abrasion resistant polyurethane material. Further, the threaded connection between the range tube 18 and the housing 36 is not subject to galling due to exposure to sand or silt contaminants because it is not necessary to remove the housing 36 from the range tube 18 in order to change the insert member 34.

If the threaded connection between the housing 36 and the collar 38 should ever become galled or unworkable due to exposure to sand or silt contaminants, it is substantially less expensive to replace the housing 36 and collar 38 than the range tube 18 which is typically welded to the elbow 16.

From the foregoing, it will be appreciated that the nozzle 20 of the present invention provides a device by which the size and shape of the outlet of an irrigation sprinkler may be selectively varied to achieve any desired combination of flow rate and distribution or range of throw from the sprinkler. Further, the nozzle 20 may be fabricated conveniently and economically, includes a housing having an extended wear life, and can be adapted to automatically control the reverse rotational speed of a part-circle reaction drive sprinkler.

While several particular forms of the invention have been illustrated and described, it will also be apparent that various modifications can be made without departing from the spirit and scope of the invention.

I claim:

1. For use in an irrigation sprinkler including a water discharge tube, an interchangeable nozzle apparatus comprising:

an elongated tubular housing having a generally cylindrical hollow interior, said housing being attached to a water discharge end of said discharge tube and extending axially outwardly therefrom;

an insert member disposed in said housing and abutting said water discharge end of said discharge tube, said insert member having an inlet and an outlet communicating through a passage, said inlet having an inside diameter substantially equal to the inside diameter of said discharge end of said discharge tube, said outlet having an inside diameter less than the inside diameter of said inlet, and said insert including longitudinally extending external ribs defining an exterior surface sized to slidably fit within said housing; and said insert is releasably retained in said housing by a collar which bears against a shoulder on said ribs and urges said inlet into abutting contact with said discharge end of said discharge tube.

2. An apparatus as set forth in claim 1 wherein said insert member includes an inner wall defining said passage which converges toward the center of said insert at a gradually decreasing rate from said inlet to said outlet, said inner wall terminating in a substantially straight bore portion adjacent said outlet.

3. An apparatus as set forth in claim 1 wherein said insert member includes an inner wall defining said passage and having an inside diameter which decreases at a constant rate from said inlet to said outlet.

4. An apparatus as set forth in claim 1 wherein said insert member includes an inner wall defining said passage and having an inside diameter which decreases at a constant rate from said inlet toward said outlet to a point where said inner wall defines a predetermined inside diameter, said inside diameter of said passage remaining constant from said point to said outlet.

5. An interchangeable nozzle for enhancing the range of a sprinkler, said nozzle comprising:

a generally tubular body having a passage therethrough for receiving water supplied to said sprinkler, said body including a generally cylindrical exterior surface sized to slidably fit in a generally cylindrical housing within which said nozzle is held adjacent to a discharge outlet of said sprinkler;

an inlet to said passage and an outlet from said passage, said inlet having an inside diameter substantially equal to the inside diameter of said discharge outlet of said sprinkler, and substantially greater than the inside diameter of said passage outlet;

an inner wall of said tubular body which converges from said passage inlet to said passage outlet at a gradually decreasing slope with respect to the axis of said tubular body until said wall forms a substantially straight bore portion of said passage adjacent said passage outlet; and a collar on said housing for releasably abutting a shoulder formed on said body for urging said inlet into abutting contact with said discharge outlet of said sprinkler.

6. An interchangeable nozzle for enhancing the range of a sprinkler, said nozzle comprising:

a generally tubular body having a passage therethrough for receiving water supplied to said sprinkler, said body including longitudinally extending external ribs for cooperating with a housing within which said nozzle is held adjacent to a discharge outlet of said sprinkler, said body being releasably held in abutting contact with said discharge outlet by a collar on said housing in bearing engagement with said ribs;

an inlet to said passage and an outlet from said passage, said inlet having an inside diameter substantially equal to the inside diameter of said discharge outlet of said sprinkler, and substantially greater than the inside diameter of said passage outlet; and an inner wall of said tubular body which converges from said passage inlet to said passage outlet at a gradually decreasing slope with respect to the axis of said tubular body until said wall forms a substantially straight bore portion of said passage adjacent said passage outlet.

7. In an irrigation sprinkler of the large gun reaction drive type having a water supply pipe, an elbow for directing water supplied from said pipe into a range tube having a water discharge end, a nozzle adjacent said water discharge end for ejecting a stream of water upwardly and outwardly from said sprinkler, and a drive arm for intermittently entering said stream of water and imparting a rotary movement to said range tube about said water supply pipe, the improvement wherein said nozzle comprises:

a tubular housing threadably disposed over said discharge end of said range tube and extending outwardly therefrom;

a set of insert members arranged to be interchangeably disposed in said housing such that an insert member so disposed abuts said discharge end of said range tube, each of said insert members having an inlet and an outlet communicating through a passage, said inlet having an inside diameter substantially equal to the inside diameter of said discharge end of said range tube, and said outlet having an inside diameter less than the inside diameter of said inlet, and each of said insert members defining an external surface which cooperates with said tubular housing such that each of said insert members fits uniformly within said housing, said insert member including an inner wall defining said passage and having an inside diameter which decreases at a constant rate from said inlet to said outlet; and a releasable collar threadably received on a discharge end of said housing and bearing against a shoulder on an insert member disposed in said housing for interchangeably retaining said insert member within said housing;

said nozzle further including an orifice ring disposed between said outlet and said collar, said orifice ring defining a water discharge aperture having a diameter less than said inside diameter of said outlet.

8. For use in an irrigation sprinkler including a water discharge tube from which a continuous stream of water is ejected, a forward drive arm to provide incremental rotational movement in a forward direction, and a reverse drive arm movable into the stream of water to provide a reverse rotational movement, an interchangeable nozzle apparatus comprising:

a tubular housing secured to a water discharge end of said discharge tube;

an insert member disposed in said housing and abutting said water discharge end of said discharge tube, said insert member having an inlet and an outlet communicating through a passage, said inlet having an inside diameter substantially equal to the inside diameter of said discharge end, and said outlet having an inside diameter less than the inside diameter of said inlet;

means for releasably retaining said insert member within said housing;

an axially extending portion projecting outwardly of said housing; and means on said reverse drive arm for cooperating with said extending portion to limit movement of said reverse drive arm into said stream.

9. A nozzle as defined in claim 8 wherein said extending portion is formed integrally on said insert member.

10. A nozzle as defined in claim 8, further including an orifice ring disposed between said insert member and said retaining means, said orifice ring defining a water discharge aperture having a diameter less than said inside diameter of said outlet, said axially extending portion secured to said orifice ring.

11. A nozzle as defined in claim 8 wherein said means for limiting movement of said reverse drive arm is an adjustable stop arranged to abut an exterior surface of said extending portion when said reverse drive arm moves into said stream.

12. A nozzle as defined in claim 11 wherein said adjustable stop comprises an externally threaded shaft received in an internally threaded bore in said reverse drive arm, said shaft having a generally flat head for abutting said extending portion.

13. In a part-circle irrigation sprinkler of the large gun reaction drive type having a water supply pipe, an elbow for directing water supplied from said pipe into a range tube having a water discharge end, a nozzle adjacent said water discharge end for ejecting a stream of water upwardly and outwardly from said sprinkler, a drive arm for intermittently entering said stream of water and imparting a rotary movement to said range tube in a first direction through a preselected arc about said water supply pipe, and a reverse drive arm for intermittently entering said stream of water and imparting a rotary movement to said range tube in a second opposite direction through the same preselected arc; the improvement comprising:

a tubular housing threadably disposed over said discharge end of said range tube and extending outwardly therefrom;

a set of insert members arranged to be interchangeably disposed in said housing such that an insert member so disposed abuts said discharge end of said range tube, each of said insert members having an inlet and an outlet communicating through a passage, said inlet having an inside diameter substantially equal to the inside diameter of said discharge end of said range tube, and said outlet having an inside diameter less than the inside diameter of said inlet, each of said insert members defining an external surface which cooperates with said tubular housing such that each of said insert members fits uniformly within said housing, and each of said insert members having an axially extending portion projecting outwardly of said housing;

a releasable collar threadably received on a discharge end of said housing and bearing against a shoulder on an insert member disposed in said housing for interchangeably retaining said insert member within said housing; and an adjustable stop on said reverse drive arm arranged to abut an exterior surface of said extending portion when said reverse drive arm enters said stream for limiting movement of said reverse drive arm into said stream.

14. In a part-circle irrigation sprinkler of the large gun reaction drive type having a water supply pipe, an elbow for directing water supplied from said pipe into a range tube having a water discharge end, a nozzle adjacent said water discharge end for ejecting a stream of water upwardly and outwardly from said sprinkler, a drive arm for intermittently entering said stream of water and imparting a rotary movement to said range tube in a first direction through a preselected arc about said water supply pipe, and a reverse drive arm for intermittently entering said stream of water and imparting a rotary movement to said range tube in a second opposite direction through the same preselected arc; the improvement comprising:

a tubular housing threadably disposed over said discharge end of said range tube and extending outwardly therefrom;

an insert member disposed in said housing abutting said discharge end of said range tube, said insert member having an inlet and an outlet communicating through a passage, said inlet having an inside diameter substantially equal to the inside diameter of said discharge end of said range tube, and said outlet having an inside diameter less than the inside diameter of said inlet;

a set of centrally apertured disc-shaped elements arranged to be interchangeably disposed adjacent a discharge end of said housing, each having an outside diameter substantially equal to the inside diameter of the discharge end of said housing and each having a central aperture of a different diameter;

an axially disposed tubular extension projecting outwardly from said housing and having its inward end secured to said disc-shaped element surrounding said central aperture; and an adjustable stop on said reverse drive arm arranged to abut an exterior surface of said tubular extension when said reverse drive arm enters said stream for limiting movement of said reverse drive arm into said stream.

15. For use in an irrigation sprinkler having a housing adjacent a discharge end of said sprinkler for selectively controlling the flow rate of a stream of water ejected from said sprinkler by interchangeably retaining one of a set of nozzle inserts within said housing, the set of nozzle inserts comprising:

generally tubular bodies, each having longitudinally extending ribs defining an external surface arranged to cooperate with an internal surface of said housing for fitting uniformly therein, said ribs having a shoulder which cooperates with a retaining collar for interchangeably retaining said insert in said housing;

each of said inserts having a passage disposed axially therethrough, said passage having an inside diameter at a first end greater than the inside diameter at a second end; and each of said inserts in said set having a different inside diameter at said second end.

16. A set of inserts as defined in claim 15 wherein the inside diameter at said first end of each of said inserts is substantially equal to the inside diameter of said discharge end of said sprinkler.

17. A set of inserts as defined in claim 15 wherein each of said inserts includes an inner wall defining said passage which converges toward the axis of said insert at a gradually decreasing rate from said first end to said second end, said inner wall terminating in a substantially straight bore portion adjacent said second end.

18. A set of inserts as defined in claim 15 wherein each of said inserts includes an inner wall defining said passage and having an inside diameter which decreases at a constant rate from said first end toward said second end.

19. A set of inserts as defined in claim 15 wherein each of said inserts includes an inner wall defining said passage and having an inside diameter which decreases at a constant rate from said first end toward said second end to a point where said inner wall defines a predetermined inside diameter, said inside diameter of said passage remaining constant from said point to said second end.

20. For use in an irrigation sprinkler including a water discharge tube, an interchangeable nozzle apparatus comprising:

a tubular housing attached to a water discharge end of said discharge tube;

an insert member disposed in said housing and abutting said water discharge end of said discharge tube, said insert member having an inlet and an outlet communicating through a passage, said inlet having an inside diameter substantially equal to the inside diameter of said discharge end of said discharge tube, and said outlet having an inside diameter less than the inside diameter of said inlet, said insert member including an inner wall defining said passage, said passage having an inside diameter which decreases at a constant rate from said inlet to said outlet;

a releasable means for retaining said insert within said housing so that said insert can be interchangeably replaced with another insert having a different outlet diameter; and said nozzle apparatus further including an orifice ring disposed between said outlet and said releasable means for retaining said insert, said orifice ring defining a water discharge aperture having a diameter less than said diameter of said outlet.

21. An interchangeable nozzle for enhancing the range of a sprinkler, said nozzle comprising:

a generally tubular body having a passage therethrough for receiving water supplied to said sprinkler;

an inlet to said passage and an outlet from said passage, said inlet having an inside diameter greater than the inside diameter of said passage outlet;

said body including longitudinally extending external ribs for cooperating with a housing within which said nozzle is held adjacent to a discharge outlet of said sprinkler; and said inside diameter of said inlet is substantially equal to the inside diameter of said discharge outlet of said sprinkler, and said nozzle is releasably held within said housing by a collar which bears against a shoulder on said ribs and urges said inlet into abutting contact with said sprinkler discharge outlet.

22. A nozzle as described in claim 21 wherein an inner wall of said tubular body defining said passage converges from said inlet to said passage outlet at a gradually decreasing slope with respect to the axis of said tubular body until said wall forms a substantially straight bore portion of said passage adjacent said passage outlet.

23. A nozzle as described in claim 21 wherein an inner wall of said tubular body defining said passage converges at a constant rate from said inlet to said passage outlet.

24. A nozzle as described in claim 21 wherein an inner wall of said tubular body defining said passage converges at a constant rate from said inlet toward said passage outlet to a point where said inner wall defines a predetermined inside diameter, said inside diameter of said passage remaining constant from said point to said passage outlet.

* * * * *